United States Patent [19]

Brown

[11] Patent Number: 4,615,282

[45] Date of Patent: Oct. 7, 1986

[54] HOT SURFACE IGNITION SYSTEM CONTROL MODULE WITH ACCELERATED IGNITER WARM-UP TEST PROGRAM

[75] Inventor: Bernard T. Brown, St. Louis Conty, Mo.

[73] Assignee: Emerson Electric Co., St. Louis, Mo.

[21] Appl. No.: 804,482

[22] Filed: Dec. 4, 1985

[51] Int. Cl.[4] ..... F23N 5/18

[52] U.S. Cl. ..... 110/186; 110/192; 431/66; 431/67

[58] Field of Search ..... 110/185, 186, 190, 191; 236/46 R, 46 E; 62/157, 158; 431/6, 18, 66, 67; 361/264

[56] References Cited

U.S. PATENT DOCUMENTS

| | | | |
|---|---|---|---|
| 4,299,095 | 11/1981 | Cassarino | 62/158 X |
| 4,444,551 | 4/1984 | Mueller et al. | 431/66 X |
| 4,518,345 | 5/1985 | Mueller et al. | 431/18 X |
| 4,560,343 | 12/1985 | Bohan, Jr. | 431/66 |

FOREIGN PATENT DOCUMENTS

| | | | |
|---|---|---|---|
| 34020 | 4/1981 | Japan | 431/67 |
| 648106 | 2/1985 | Switzerland | 431/6 |

*Primary Examiner*—Albert J. Makay
*Assistant Examiner*—Steven E. Warner
*Attorney, Agent, or Firm*—Paul A. Becker, Sr.

[57] ABSTRACT

A control module in a hot surface ignition system includes a microcomputer programmed to provide a preselected igniter warm-up time period for enabling the igniter to heat up to gas ignition temperature during normal system operation, and is further programmed to provide, for test purposes only, an accelerated igniter warm-up time period which is shorter than the preselected igniter warm-up time period but sufficiently long for enabling the igniter to heat up to a temperature sufficiently high to ignite gas. The program for providing the accelerated igniter warm-up time period is automatically executed in response to a unique signal effected by the control module in conjunction with a detachably connected test device.

3 Claims, 7 Drawing Figures

HOT SURFACE IGNITION SYSTEM CONTROL MODULE WITH ACCELERATED IGNITER WARM-UP TEST PROGRAM

BACKGROUND OF THE INVENTION

This invention relates to microcomputer-controlled gas burner control systems which utilize an electrical resistance igniter.

So-called hot surface ignition systems are gas burner control systems which utilize an electrical resistance igniter to ignite gas. In such systems, the igniter is electrically energized for a predetermined time period, sometimes referred to as the igniter warm-up time, to enable it to reach a temperature sufficiently high to ignite gas.

There are several manufacturers of igniters used in such systems. An igniter from any one manufacturer, because of its particular material composition, mass, and physical configuration, will generally heat up at a different rate to a different final temperature than an igniter from another manufacturer. For example, when energized at 115 volts, igniters from one manufacturer may heat up to a temperature sufficient to ignite gas, approximately 1600° F., in approximately 5 seconds, and to a relatively stable final temperature of approximately 2500° F. when energized for 20 seconds or longer. An igniter from another manufacturer may require more or less time to heat up to 1600° F. and may attain a lower or higher final temperature. The rate of temperature change and the final temperature attained also depends on the value of the applied voltage. Specifically, when the applied voltage is less than 115 volts, the igniter heats up slower and attains a lower final temperature than when energized at 115 volts; when the applied voltage is greater than 115 volts, the igniter heats up faster and attains a higher final temperature.

Hot surface ignition systems include a control module which, among other functions, establishes the length of the igniter warm-up time period. When it is known that a particular igniter having a fast warm-up time will be used, the length of the igniter warm-up time period can be established at a relatively low value, for example, at 15 seconds. However, when the particular igniter to be used has a slow warm-up time or it is desirable that the system is to be usable with either fast or slow warm-up time igniters, the length of the igniter warm-up time period is established at a relatively large value, for example, at 45 seconds.

With regard to system operation, the 45-second igniter warm-up time period presents no particular problem. It merely establishes that upon a call for heat, 45 seconds will be provided to enable the igniter to attain gas ignition temperature. The 45-second time period is, however, a disadvantage with regard to testing the system on the assembly line of the device incorporating the system.

Specifically, in the assembly line of the device such as a furnace or boiler utilizing the system, the system is tested to determine that it operates properly. Among tests performed is a test to determine that the igniter does, in fact, ignite gas. Unless the function of the control module is bypassed or altered in some manner for this test, the igniter will be energized for the igniter warm-up time period established by the control module. Thus, when the established igniter warm-up time is 15 seconds, a test time of 15 seconds is expended; when the established warm-up time is 45 seconds, a test time of 45 seconds is expended. Since a test time of 45 seconds, and to a lesser extent, a test time of 15 seconds, are significant cost factors, particularly in a high-volume assembly line, it is desirable to reduce such test times. A reduction of such test times is feasible since the 15-second and 45-second time periods allow for the worst operating conditions that may be encountered by the igniter, such as extremely low voltage, and are considerably longer than the actual time required for the igniter to heat up to gas ignition temperature under the more favorable operating conditions existing in an assembly line test. It is also desirable to accomplish such reductions in test times without adding cost to the system.

SUMMARY OF THE INVENTION

It is, therefore, a primary object of this invention to provide a generally new and improved control module for a hot surface ignition system, which module includes means for providing an accelerated igniter warm-up time period.

In the preferred embodiment, a control module in a hot surface ignition system includes a microcomputer which is programmed to control operation of the system. Included in the program is a program to provide an igniter warm-up time period for normal system operation. The length of this warm-up time period is preselected to be either 15 or 45 seconds, depending on whether the igniter to be used heats up rapidly or slowly to gas ignition temperature, or whether the system is to be usable with either type igniter. Also included in the program is a program to provide, for assembly line test purposes only, an accelerated igniter warm-up time period of 10 seconds.

The program for the accelerated igniter warm-up time is automatically entered in response to a unique signal at an input terminal of the control module. Specifically, an assembly line test device is connected to an input terminal of the control module. The test device connects and disconnects the input terminal to ground at predetermined time intervals, enabling a unique signal to appear at the input terminal. The signal is unique in that it cannot be generated by the system itself under any known normal or abnormal conditions.

When the unique signal appears, the accelerated igniter warm-up time program is entered and executed, resulting in the igniter being energized for 10 seconds instead of 15 or 45 seconds. A particular advantage of this arrangement is that the desired function of accelerating the igniter warm-up time is achieved in software in the control module, in conjunction with an assembly line test device, thus negating the addition of any hardware to the hot surface ignition system itself, which hardware would increase the cost and complexity of the system.

The above mentioned and other objects and features of the present invention will become apparent from the following description when read in conjunction with the accompanying drawings.

DESCRIPTION OF THE PREFERRED EMBODIMENT

Figure 1:
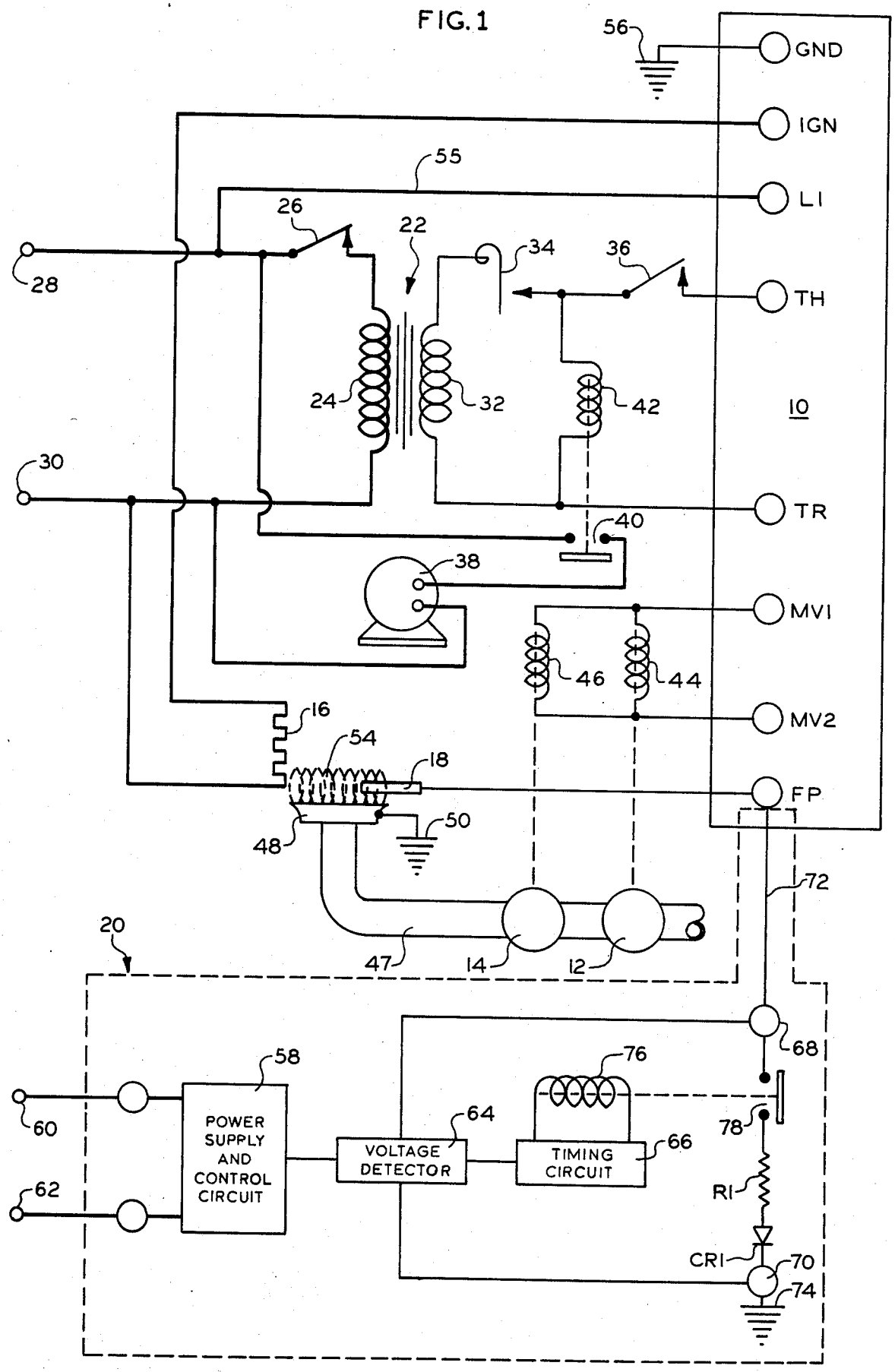
FIG. 1 is a diagrammatic illustration of a hot surface ignition system constructed in accordance with the present invention, and shown with an assembly line test device connected to an input terminal of the control module.

Referring to FIG. 1, the hot surface ignition system of the present invention includes, as primary components, a control module 10, a first valve 12 and a second valve 14, an igniter 16, and a flame probe 18. Shown connected to a terminal of control module 10 is a test device 20. As will be described hereinafter, test device 20 is utilized only during assembly line testing of the system and is not a component of the system.

The system includes a voltage step-down transformer 22 having a primary winding 24 connected through a conventional normally-closed warm-air limit switch 26 to terminals 28 and 30 of a conventional 115 volt alternating current power source. The secondary winding 32 of transformer 22 is connected at one end through a space thermostat 34 and a pressure switch 36 to a terminal TH of control module 10 and and at its other end to a terminal TR of control module 10, and provides a 24-volt alternating current power source for control module 10.

A fan 38 is connected across power source terminals 28 and 30 through a set of normally-open relay contacts 40. Relay contacts 40 are controlled by a relay coil 42 which is connected across secondary winding 32 of transformer 22 through thermostat 34. Thus, whenever thermostat 34 is calling for heat, fan 38 is energized. When fan 38 is energized, pressure switch 36 senses the flow of air and closes its contacts, thus enabling 24 volts to be applied to terminals TH and TR of control module 10.

Fan 38 and pressure switch 36 are generally positioned in the flue of a furnace (not shown) so as to be in air-flow communication with the combustion chamber of the furnace. Fan 38 provides the air required for obtaining a combustible air-gas mixture by inducing air into the combustion chamber, and provides means for forcing the products of combustion out of the combustion chamber through the flue. As will be described hereinafter, fan 38 is also selectively energizable by control module 10 before initiation of energizing of igniter 16, and is always energized between unsuccessful attempts at ignition and after a loss of burner flame, to purge the combustion chamber of any accumulated unburned fuel or products of combustion. The utilization of fan 38 is required for those direct ignition systems, that is, systems in which the main burner is directly ignited by igniter 16, in which the combustion chamber of the furnace is sealed. It is to be understood, however, that there are other applications of direct ignition systems, such as in some natural-draft furnaces, in which the fan 38 is not required and can be omitted.

A first valve winding 44 is connected across terminals MV1 and MV2 of control module 10. A second valve winding 46 is connected in parallel with first valve winding 44. First valve winding 44 controls the first valve 12 and second valve winding 46 controls the second valve 14. Valves 12 and 14 are connected fluidically in series in a gas conduit 47 leading from a gas source (not shown) to a gas burner 48. Burner 48 is grounded at 50.

Both valves 12 and 14 must be open to enable gas to flow to burner 50 so as to establish a burner flame 54. It is to be understood that valves 12 and 14 can be separate devices as illustrated or a unitary device. Utilization of such a redundant valve arrangement, wherein two serially-connected valves control the flow of gas to a burner, is well known in the art.

Igniter 16 is connected at one end to power source terminal 30 and at its other end to a terminal 1GN of control module 10. A lead 55 connects a terminal L1 of control module 10 to the other power source terminal 28.

Control module 10 further includes a terminal GND which is grounded at 56, and a terminal FP to which flame probe 18 and test device 20 are connected.

Test device 20 includes a power supply and control circuit 58 adaptable for connection to a conventional 115 volt alternating current power source at terminals 60 and 62. Interconnected with power supply and control circuit 58 are a voltage detector 64 and a timing circuit 66. Voltage detector 64 is connected between a terminal 68 and a terminal 70 of test device 20. Terminal 68 is connected by a lead 72 to terminal FP of control module 10, and terminal 70 is grounded at 74. The output of timing circuit 66 includes a relay coil 76 which controls a set of normally-open contacts 78. Contacts 78 are connected in series with a resistor R1 and a controlled rectifier CR1 between terminals 68 and 70 of test device 20.

Figure 2A:
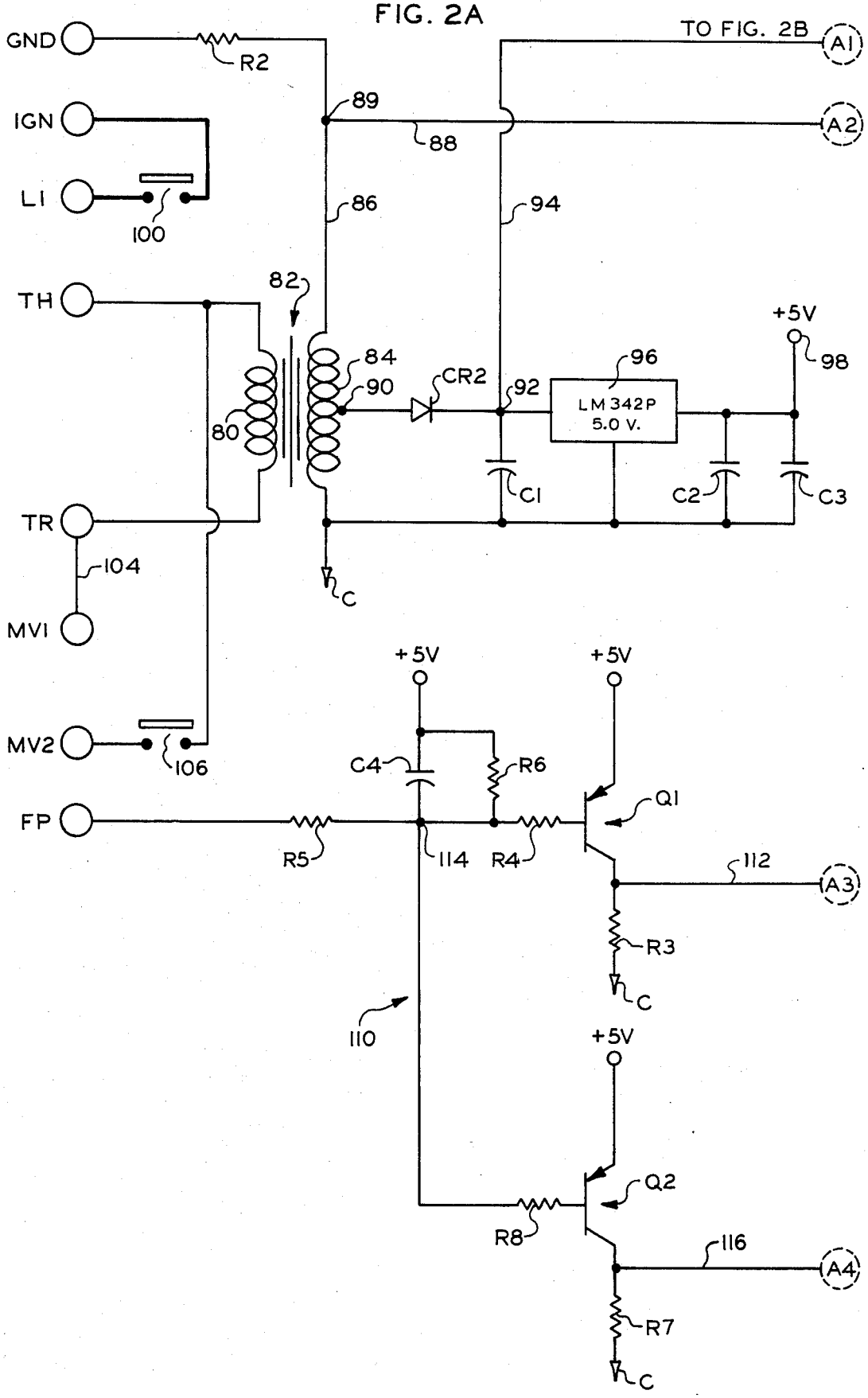
FIGS. 2A and 2B, when combined, is a diagrammatic illustration of the control module of FIG. 1.
Figure 2B:
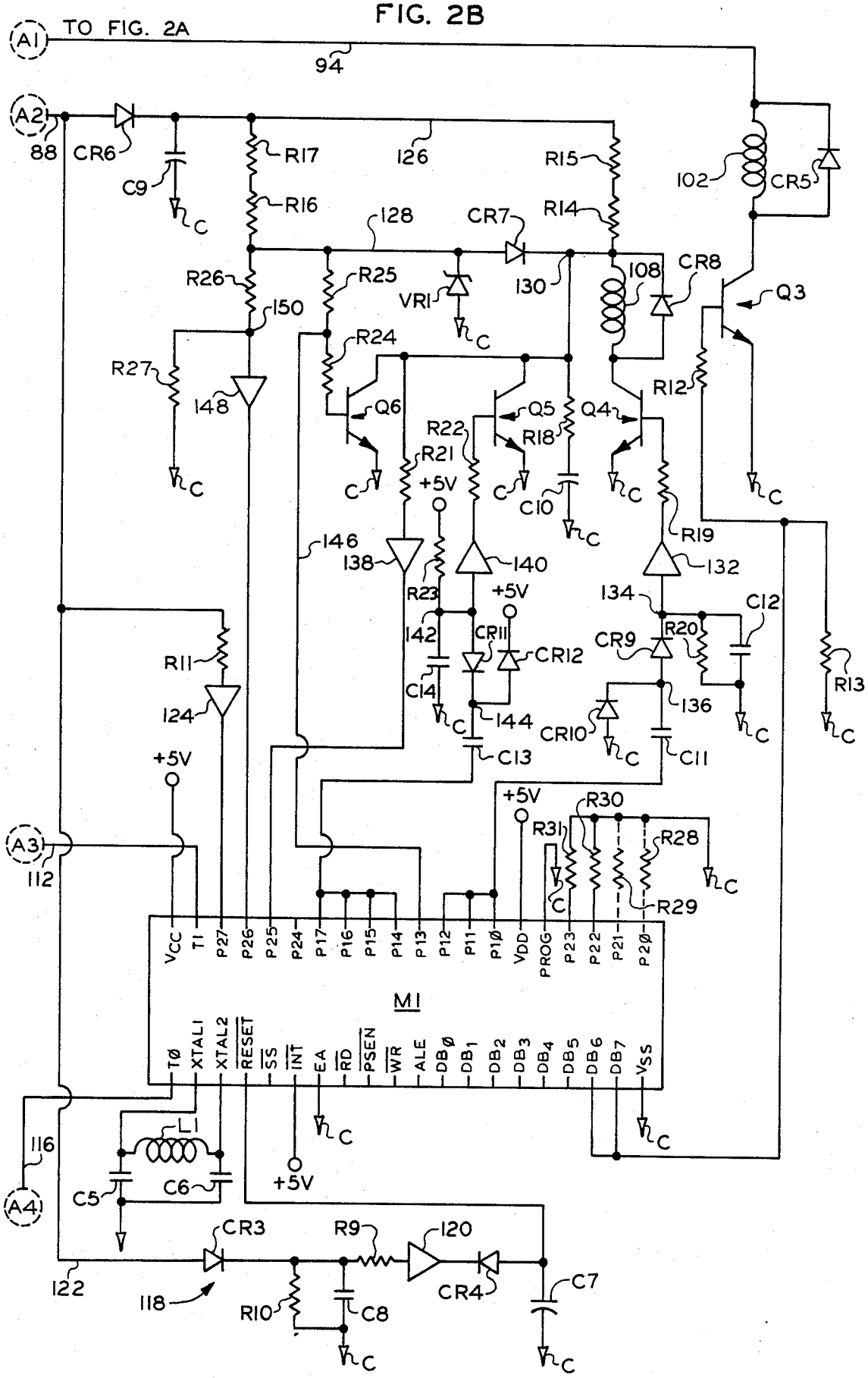

The diagrammatic illustration of control module 10 is obtained by placing FIG. 2A to the left of FIG. 2B. When so combined, the connecting points A1, A2, A3, and A4 of FIG. 2A are aligned with the connecting points A1, A2, A3, and A4 of FIG. 2B. Additionally, the diagrammatic illustration of the complete system can be obtained by placing FIG. 1 to the left of FIG. 2A so that the terminals of control module 10 are aligned.

Referring to FIG. 2A, the primary winding 80 of a voltage step-up isolation transformer 82 is connected across terminals TH and TR in control module 10. One end of the secondary winding 84 of transformer 82 is connected to chassis common C which is isolated from earth ground. The other end of secondary winding 84 is connected through a lead 86 and a lead 88 to connecting point A2 and provides an alternating current power source of approximately 34 volts between lead 88 and common C. A resistor R2 is connected between the junction 89 of leads 86 and 88 and terminal GND, which is grounded at 56 in FIG. 1, and prevents the flow of excessively high current through secondary winding 84 if common C should accidentally be connected to earth ground.

Secondary winding 84 of isolation transformer 82 has a winding tap 90 which is connected through a controlled rectifier CR2 to a junction 92. A filter capacitor C1 is connected between junction 92 and common C and cooperates with the unidirectional flow through rectifier CR2 to provide a filtered unidirectional power source of approximately 15 volts on a lead 94 connected between junction 92 and connecting point A1. This 15 volt source is also applied to the input of a commercially available 5 volt regulated power supply 96 which in turn provides a +5 volt power source between a terminal 98 and common C. A capacitor C2 is connected between terminal 98 and common C and cooperates with power supply 96 to stabilize the +5 volt power source. A capacitor C3 is connected between terminal 98 and common C and functions as a transient suppressor.

Connected between terminals 1GN and L1 of control module 10 is a set of normally-open relay contacts 100. Referring to FIGS. 1 and 2A, when relay contacts 100 are closed, igniter 16 is connected across power source terminals 28 and 30. Controlling operation of relay contacts 100 is a relay coil 102 shown in FIG. 2B.

Connected between terminals TR and MV1 of control module 10 is a lead 104, and connected between terminals TH and MV2 is a set of normally-open relay contacts 106. Referring to FIGS. 1 and 2A, when relay contacts 106 are closed, valve windings 44 and 46 are connected across secondary winding 32 of transformer 22 when thermostat 34 is calling for heat and pressure switch 36 is closed. Controlling operation of relay contacts 106 is a relay coil 108 shown in FIG. 2B.

A flame rectification circuit is shown generally at 110 in FIG. 2A. Circuit 110 includes a first PNP transistor Q1 having its emitter connected to the +5 volt power source and its collector connected through a resistor R3 to common C. The collector of transistor Q1 is further connected to a lead 112 which is connected to connecting point A3. Series connected between the base of transistor Q1 and terminal FP of control module 10 are resistors R4 and R5. A capacitor C4 and a resistor R6 are connected in parallel with each other between the +5 volt source and the junction 114 of resistors R4 and R5.

For the purpose of redundancy, flame rectification circuit 110 includes a second PNP transistor Q2. The emitter of transistor Q2 is connected to the +5 volt source, and its collector is connected through a resistor R7 to common C. The collector of transistor Q2 is further connected to a lead 116 which is connected to connecting point A4. A resistor R8 is connected between the base of transistor Q2 and junction 114.

Referring to FIGS. 1 and 2A, probe 18 is positioned so as to be impinged by the burner flame 54. When burner flame 54 exits, both transistors Q1 and Q2 are biased on by current through the burner flame 54 during the half-cycle that current freely flows through the burner flame 54, and by the discharge current of capacitor C4 during the non-conducting half-cycle of burner flame 54. Specifically, during the half-cycle in which current freely flows through burner flame 54, transistor Q1 is biased on, the circuit being: from secondary winding 84 of transformer 82 through common C, the +5 volt source, the emitter-base circuit of transistor Q1, resistors R4 and R5, probe 18, burner flame 54, burner 48, ground 50 at burner 48, ground 56 at terminal GND, resistor R2, and lead 86 back to secondary winding 84. Similarly. transistor Q2 is biased on, the circuit being: from secondary winding 84 through common C, the +5 volt source, the emitter-base circuit of transistor Q2, resistors R8 and R5, probe 18, burner flame 54, burner 48, ground 50 at burner 48, ground 56 at terminal GND, resistor R2, and lead 86 back to secondary winding 84. Capacitor C4 is also charged during this half-cycle. When the voltage on secondary winding 84 reverses, burner flame 54 essentially blocks the reverse-polarity current. During this reverse-polarity half-cycle, capacitor C4 dischages through the emitter-base circuits of transistor Q1 and Q2 to keep transistors Q1 and Q2 biased on.

With transistor Q1 on, its collector is high, causing the signal on lead 112 to be high; with transistor Q2 on, its collector is high, causing the signal on lead 116 to be high. Thus, in the presence of burner flame 54, transistors Q1 and Q2 are on and the signals on leads 112 and 116 are high. The values of the circuit components are such that capacitor C4 can maintain transistors Q1 and Q2 conductive for approximately 80 milliseconds. This 80-millisecond time period is sufficiently greater than a half-cycle of the 60 Hz. source so as to ensure continued conduction of transistors Q1 and Q2 when burner flame 54 blocks current flow, and, as will hereinafter be described, is sufficiently small so as not to interfere with a timebased means for monitoring the existence of burner flame 54.

In the absence of burner flame 54, the air-gap impedance between probe 18 and burner 48 is sufficiently great to prevent transistors Q1 and Q2 from being biased to their conducting state. Thus, in the absence of burner flame 54, transistors Q1 and Q2 are off and the signals on leads 112 and 116 are low.

Referring to FIG. 2B, shown therein is a signal component 8-bit microcomputer M1. Included within microcomputer M1 are an 8-bit CPU (central processing unit), a 1K×8 ROM (read only memory), a 64×8 RAM (random access read/write memory), 24 I/O (input-/output) lines, a clock, and an 8-bit timer/event counter. The pins of microcomputer M1 are designated $V_{CC}$, $V_{DD}$, $V_{SS}$, P1Ø through P17, P2Ø through P27, $DB_Ø$ through $DB_7$, TØ and T1, PROG, XTAL1 and XTAL2, $\overline{RESET}$, $\overline{SS}$, $\overline{INT}$, EA, $\overline{RD}$, $\overline{PSEN}$, $\overline{WR}$, and ALE.

Pin $V_{CC}$ of microcomputer M1 is connected to the +5 volt power source and functions as the main power supply input to microcomputer M1. Also connected to the +5 volt source are pins $V_{DD}$ and $\overline{INT}$. Pin $V_{SS}$ is connected to common C and functions as the connection of microcomputer M1 to common C potential. Also connected to common C are pins EA and PROG.

An external timing control circuit for the on-chip oscillator comprises a capacitor C5 connected between pin XTAL1 and common C, a capacitor C6 connected between pin XTAL2 and common C, and an inductor L1 connected across pins XTAL1 and XTAL2. The values of capacitors C5 and C6 and inductor L1 are such that the on-chip oscillator provides a cycle speed of approximately 5 microseconds.

A rest circuit for initializing microcomputer M1 is shown generally at 118. Reset circuit 118 includes a capacitor C7 connected between the $\overline{RESET}$ pin and common C. Reset circuit 118 further includes the series connection of a rectifier CR3, a resistor R9, a buffer 120, and a rectifier CR4 connected to the $\overline{RESET}$ pin and through a lead 122 and leads 88 and 86 to secondary winding 84 of isolation transformer 82, and a resistor R10 and a capacitor C8 connected in parallel with each other between the cathode of rectifier CR3 and common C.

When power is applied to reset circuit 118, capacitor C8 is completely discharged so that the input, and thus the output, of buffer 120 is initially low. With the output of buffer 120 low, the voltage at $\overline{RESET}$ pin is low, causing microcomputer M1 to reset. Capacitor C8 quickly charges, causing the input, and thus the output, of buffer 120 to go high. When the output of buffer 120 is high, rectifier CR4 blocks, enabling capacitor C7 to begin to be charged by the +5 volt power source through an internal pull-up resistance provided between the +5 volt source and the $\overline{\text{RESET}}$ pin in microcomputer M1. After a time period sufficient for the +5 volt source to have become stable, capacitor C7 charges sufficiently to make the $\overline{\text{RESET}}$ pin high. With the $\overline{\text{RESET}}$ pin high, microcomputer M1 enters its run mode.

On a momentary power interruption, capacitor C8 quickly dischages through resistor R10, causing the input, and thus the output, of buffer 120 to go low. This low enables capacitor C7 to discharge and thus causes $\overline{\text{RESET}}$ pin to go low which causes microcomputer M1 to reset. When power is resumed, microcomputer M1 resets and enters its run mode as described above.

Connected in series between lead 122 and pin P27 are a resistor R11 and a buffer 124. Resistor R11 and buffer 124 function to convert the 60 Hz. alternating current signal on lead 122 to a 60 Hz. square wave signal, thus providing a real time base for microcomputer M1.

Relay winding 102, as previously described, controls operation of its contacts 100 which, in turn, control energizing of igniter 16. Relay winding 102 is connected at one end to lead 94 and at its other end to common C through an NPN transistor Q3. A rectifier CR5 is connected across relay winding 102 to suppress any back EMF generated by relay winding 102, thereby protecting transistor Q3 from any high voltage or high current due to such EMF generation. The base of transistor Q3 is connected through a resistor R12 to pins $DB_6$ and $DB_7$ of microcomputer M1, and through resistor R12 and a resistor R13 to common C.

When it is desired to energize relay winding 102, a current for biasing transistor Q3 on is provided from microcomputer M1 at pins $DB_6$ and $DB_7$. With transistor Q3 on, relay winding 102 is energized by the 15 volt filtered unidirectional power source on lead 94.

Relay winding 108, as previously described, controls operation of its contacts 106 which, in turn, control energizing of valve windings 44 and 46 of gas valves 12 and 14, respectively. Relay winding 108 is connected at one end to lead 88 through a pair of resistors R14 and R15, a lead 126, and a rectifier CR6, and at its other end to common C through an NPN transistor Q4. A filter capacitor C9 is connected between lead 126 and common C and cooperates with the unidirectional flow through rectifier CR6 to provide a filtered unidirectional power source of approximately 30 volts on lead 126.

Relay winding 108 is also connected to lead 126 through a rectifier CR7, a lead 128, and a pair of resistors R16 and R17. A voltage regulator VR1 is connected between lead 128 and common C and functions to maintain lead 128 at approximately 5.1 volts. A rectifier CR8 is connected across relay winding 108 to suppress any back EMF generated by relay winding 108, thereby protecting transistor Q4 from any high voltage or high current due to such EMF generation. A capacitor C10, for effecting energizing of relay winding 108, is connected from common C through a resistor R18 to a junction 130 between rectifier CR7 and relay winding 108.

The base of transistor Q4 is connected through a resistor R19, a buffer 132, a rectifier CR9, and a capacitor C11 to pins P1Ø, P11, and P12 of microcomputer M1. A high-pass filter arrangement of a parallel-connected resistor R20 and capacitor C12 is connected between common C and a junction 134 between rectifier CR9 and buffer 132. A rectifier CR10 is connected between common C and a junction 136 between capacitor C11 and rectifier CR9.

The collectors of two NPN transistors Q5 and Q6 are connected to junction 130, and through a resistor R21 and a buffer 138 to pin P25 of microcomputer M1. The emitters thereof are connected to common C.

The base of transistor Q5 is connected through a resistor R22, a buffer 140, a rectifier CR11, and a capacitor C13 to pins P14, P15, P16, and P17 of microcomputer M1. A resistor R23 is connected between the +5 volt source and the input of buffer 140 at a junction 142. A capacitor C14 is connected between junction 142 and common C. A rectifier CR12 is connected between the +5 volt source and a junction 144 between rectifier CR11 and capacitor C13.

The base of transistor Q6 is connected through a resistor R24 and a lead 146 to pin P13 of microcomputer M1, and through resistor R24 and a resistor R25 to lead 128.

Connected in series between lead 128 and pin P26 of microcomputer M1 are a resistor R26 and a buffer 148. A resistor R27 is connected between common C and a junction 150 between resistor R26 and a buffer 148.

It is noted that capacitor C10 is in parallel with series-connected relay winding 108 and transistor Q4, and in parallel with both transistors Q5 and Q6. As will hereinafter be described, when energizing of relay winding 108 is not desired, microcomputer M1 provides for conduction of transistors Q5 and Q6 and nonconduction of transistor Q4, and when energizing of relay winding 108 is desired, provides for non-conduction of all three transistors Q4, Q5, and Q6 for a sufficient time period to enable capacitor C10 to charge, and then provides for conduction of transistor Q4 and continued non-conduction of transistors Q5 and Q6 to enable energizing of relay winding 108 by the discharging of capacitor C10 through relay winding 108 and transistor Q4.

Regarding transistor Q5, when conduction of transistor Q5 is desired, microcomputer M1 provides a constant digital high signal at pins P14 through P17. Under this condition, capacitor C14 is charged by the +5 volt source through resistor R23, putting a high on the input of buffer 140. The output of buffer 140 is therefore high and transistor Q5 is biased on. Capacitor C13 and rectifier CR11 prevent the constant high signal at pins P14 through P17 from changing the state of buffer 140. When conduction of transistor Q5 is not desired, microcomputer M1 provides a high frequency digital signal of approximately 1K Hz. at pins P14 through P17. When the signal is low, capacitor C14 discharges through rectifier CR11, capacitor C13, and pins P14 through P17, causing the input, and thus the output, of buffer 140 to go low. With the output of buffer 140 low, transistor Q5 is biased off. When the signal at pins P14 through P17 goes high, capacitor C14 begins to charge, but is prevented by the high resistance value of resistor R23 and the short time duration of the high portion of the 1K Hz. signal from charging sufficiently to change the state of buffer 140.

Regarding transistor Q6, when conduction of transistor Q6 is desired, microcomputer M1 provides a constant digital high signal at pin P13. With a constant high at pin P13, transistor Q6 is biased on through resistor R24. When conduction of transistor Q6 is not desired, microcomputer M1 provides a constant digital low signal at pin P13, causing transistor Q6 to turn off.

Regarding transistor Q4, when conduction of transistor Q4 is not desired, microcomputer M1 provides a constant digital high signal at pins P1Ø through P12. When the constant high exists, capacitor C11 blocks the constant high signal and capacitor C12 is discharged, making the input of buffer 132 low. With the input of buffer 132 low, the output thereof is low and transistor Q4 is therefore biased off. When conduction of transistor Q4 is desired, microcomputer M1 provides a high frequency digital signal of approximately 1K Hz. at pins P1Ø through P12. When the signal first goes low, basically nothing happens. When the signal goes high, capacitor C12, which is in parallel with a 1 megohm resistor R20, is charged to a sufficiently high voltage to cause the input, and thus the output, of buffer 132 to go high. With the output of buffer 132 high, transistor Q4 is biased on. When the 1K Hz. signal goes low, capacitor C12 discharges through resistor R20, the discharge time constant being sufficiently long to keep the input of buffer 132 high, and thus to keep transistor Q4 biased on for the duration of the low portion of the 1K Hz. signal.

To effect energizing of relay winding 108, it is necessary to charge capacitor C10 to a voltage sufficiently high to effect pull-in of relay winding 108 upon discharge thereof. Since capacitor C10 is in parallel with series-connected relay winding 108 and transistor Q4, and in parallel with transistors Q5 and Q6, it is necessary that all three transistors Q4, Q5, and Q6 be off in order to enable capacitor C10 to charge.

When all three transistors Q4, Q5, and Q6 are off, capacitor C10 is charged through two circuits. The first circuit includes resistors R17 and R16, rectifier CR7, and resistor R18. As previously stated, voltage regulator VR1 limits the voltage on lead 128 to approximately 5.1 volts. Thus the voltage at junction 130, when rectifier CR7 is conducting, is approximately 4.5 volts. Relay winding 108 requires at least 6 volts to effect pull-in thereof, so this first circuit cannot effect pull-in. The second charging circuit for capacitor C10 includes resistors R15, R14, and R18. This second circuit enables charging capacitor C10 with the voltage source of approximately 30 volts appearing on lead 126. When capacitor C10 is charged by this voltage, it is rendered capable of pulling in relay winding 108. The values of capacitor C10 and of resistors R14, R15, R16, R17, and R18 are such that capacitor C10 is charged to the required pull-in voltage level within 2 seconds. Therefore, when transistor Q4 is turned on after being off for at least 2 seconds, and transistors Q5 nd Q6 remain off, capacitor C10 discharges through resistor R18, relay winding 108, and transistor Q4, effecting pull-in of relay winding 108. As will be hereinafter described, although only 2 seconds are required, 4 seconds are actually provided.

Once relay winding 108 is pulled in, the voltage at junction 130 decreases due to the impedance of relay winding 108 being considerably less than the combined impedance of resistors R14 and R15. However, due to regulator VR1, the voltage at junction 130 is held at approximately 4.5 volts, a level sufficient to maintain energizing of relay winding 108 which can be held in with approximately 3.4 volts. Thus, once relay winding 108 is pulled in, it is held in through resistors R17 and R16 and rectifier CR7.

It should be noted that transistors Q5 and Q6, while not essential, are provided to enhance the safety and reliability of the system. Specifically, the provision of transistors Q5 and Q6 negates the development of any unsafe condition should transistor Q4 be operated improperly, such as, for example, by becoming conductive, due to a false signal from microcomputer M1, before igniter 16 is sufficiently heated to gas ignition temperature. To determine that transistors Q5 and Q6 are capable of providing their safety function, they are checked by microcomputer M1 during each burner cycle. Specifically, during the time period while igniter 16 is heating and transistors Q5 and Q6 are on, microcomputer M1 provides a constant digital low signal at pin P13 for 1 second, causing transistor Q6 to turn off. Pin P25 of micocomputer M1 is monitored to determine if the input thereto is high or low. If the input is high, the system goes into lockout since a high would indicate that transistor Q5, which should still be on, is off. That is, with transistor Q6 off and transistor Q5 on, the signal through resistor R21 and buffer 138 to pin P25 must be low, not high. After this 1-second low signal at pin P13, microcomputer M1 provides the previously-described 1K Hz. signal at pins P14 through P17 for 1 second, causing transistor Q5 to turn off. If the input signal to pin P25 is high, the system enters lockout since a high would indicate that transistor Q6 is off when it should be on.

The lockout condition referred to above is a condition wherein all outputs of microcomputer M1 which control igniter 16 and gas valves 12 and 14 are in such a mode so as to prevent energizing of igniter 16 and opening of valves 12 and 14. The lockout condition can be removed by opening thermostat 34.

Also enhancing the safety of the system is the provision of voltage regulator VR1. Should transistors Q5 and Q6 be off and transistor Q4 be on at some time other than when capacitor C10 is to effect pull-in of relay winding 108, current would flow through relay winding 108 from lead 126 through resistors R15 and R14, and through resistors R17 and R16 and rectifier CR7. Because of the relatively low impedance of relay winding 108 with respect to resistors R14 and R15, the voltage across relay winding 108 due to the current flow through resistors R14 and R15 would be considerably less than the 6 volts required to pull it in. However, since the resistance values of resistors R16 and R17 are relatively low, the voltage across relay winding 108 due to the current flow through resistors R16 and R17 and rectifier CR6 could conceivably be high enough to pull in relay winding 108 were it not for voltage regulator VR1 which limits the voltage at junction 130 to approximately 4.5 volts. To determine that regulator VR1 is functional, microcomputer M1 monitors the signal at pin P26 at a time when transistors Q5 and Q6 are off. Resistors R26 and R27 function as a voltage divider to provide a signal at junction 150 on the input of buffer 148. If regulator VR1 is functional, the signal on the input, and thus the output, of buffer 148 will be low; if the regulator VR1 is non-functional, the signal will be high, causing the system to lock out.

Another factor enhancing the safety of the system is that transistors Q4, Q5, and Q6 are biased to the required modes by diverse signals from a single port of microcomputer M1. Specifically, for transistors Q5 and Q6 to be off and transistor Q4 to be on, a condition for effecting pull-in of relay winding 108 by the discharging of charged capacitor C10, the signal on port P1, bits 4 through 7, has to be the 1K Hz. signal previously described; the signal on port P1, bit 3, has to be a constant low; and the signal on port P1, bits Ø, 1, and 2, has to be the 1Hz. signal. It is believed extremely unlikely that a malfunction of microcomputer M1 could cause such a diverse condition to develop.

Yet another factor enhancing the safety of the system is a self-check of the ROM and RAM in microcomputer M1 to ascertain that the chip in microcomputer M1 has not become defective. The 1K×8 ROM is programmed in 4 pages, each page being 256 words. Each page utilizes a small number of words to provide instructions for implementing the self-check of ROM and RAM. For self-check of ROM, the instructions are to add up each bit of each remaining 8-bit word on each page, to compare the resulting 8-bit word sum with a calculated 8-bit word sum which is stored in one of the instructions, to perform this function on subsequent pages if the previous page showed that the checked sum agreed with the calculated sum, and to enter lockout if the checked and calculated sums on any page do not agree. For self-check of RAM, portions of ROM subject to the ROM self-check provide instructions to place a binary 1 in each bit of each 8-bit word in the 64×8 RAM, except in several counters which implement and terminate the RAM self-check, to compare each resulting 8-bit word with a single 8-bit word therein, to repeat the process with a binary Ø in each bit, and to enter lockout if any comparison shows that any bit is incorrect. This ROM and RAM self-check is performed during each power up of microcomputer M1.

Four resistors R28, R29, R30, and R31 are shown in FIG. 2B, some of which are connected to various pins of microcomputer M1 and other of which, as indicated by dashed lines instead of solid lines, are not connected. As will be hereinafter described, the connection or non-connection determines certain system functions.

For example, in the program of microcomputer M1, a digital high at pin P2Ø establishes a pre-purge time of 30 seconds, and a digital low establishes that there will be no pre-purge, pre-purge being the time period between the initiation of a burner cycle and the initiation of energizing of igniter 16. When fan 38 is provided, it operates during this pre-purge time period to purge the combustion chamber; when fan 38 is not provided, the pre-purge time period provides time for the combustion chamber to vent itself. With resistor R28 not connected, as shown in FIG. 2B, pin P2Ø is high and the 30-second pre-purge time period is therefore established. It is to be noted that not all systems require pre-purge. Therefore, this means for providing or not providing a pre-purge enables control module 10 to be readily constructed for use in a wide variety of applications.

In the program of microcomputer M1, a digital high at pins P22 and P23 establishes that there will be one attempt at ignition before lockout; a digital low establishes that there can be three attempts before lockout. In FIG. 2B, resistors R30 and R31 are shown connected to pins P22 and P23, respectively, so that pins P22 and P23 are low, and thus three ignition attempts can be made.

In the program of microcomputer M1, a digital high at pin P21 provides a warm-up time for igniter 16 of 45 seconds, and a digital low at pin P21 provides a warm-up time of 15 seconds. Therefore, with resistor R29 not connected, as shown in FIG. 2B, pin P21 is high and the warm-up time is 45 seconds. If resistor R29 were connected, pin P21 would be coupled to common C through resistor R29 and would be low so as to establish the 15-second warm-up time. This means for providing selective warm-up times for igniter 16 simplifies the adapting of the system to various types of igniters having different heating characteristics or to unusual operating conditions, such as consistently low or high voltage supply, so as to provide sufficient time to heat the igniter to gas ignition temperature and yet prevent an unnecessarily long warm-up time.

Several manufacturers presently produce igniters, generally of siliconcarbide, for use in hot surface ignition systems. While all such igniters attain gas ignition temperature, some attain the ignition temperature more quickly than others.

Figure 3:
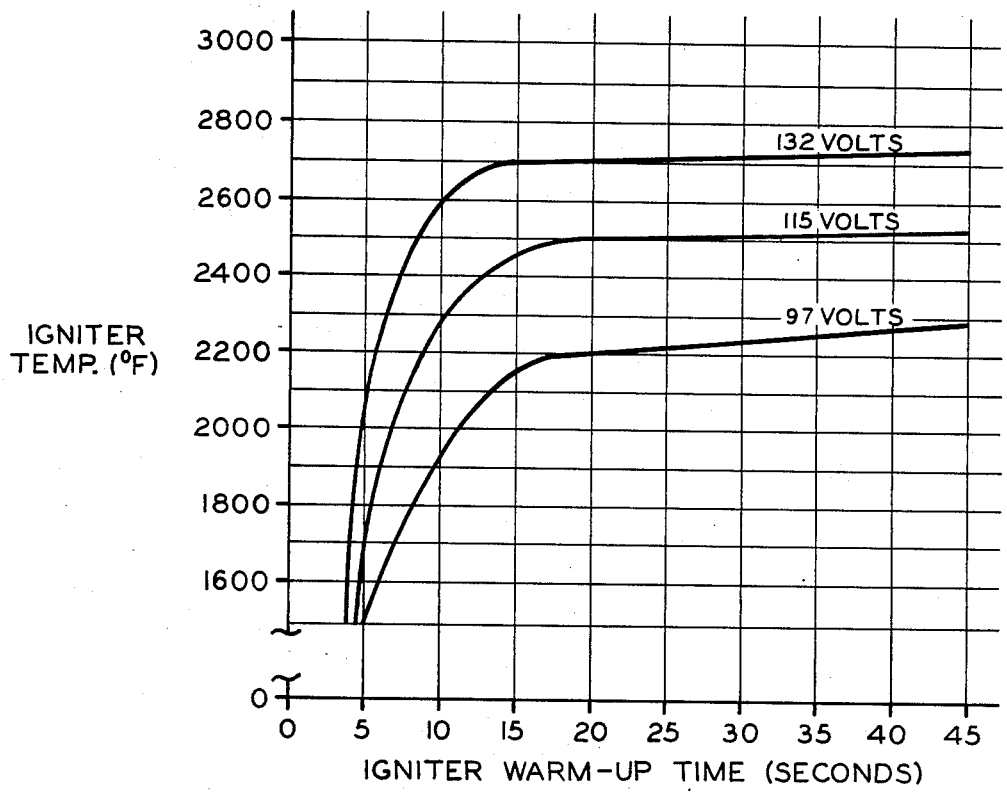
FIG. 3 is a time-temperature chart depicting the heating characteristics of a fast warm-up igniter at different values of applied voltage.

For example, referring to FIG. 3, shown generally therein is a time-temperature chart of one manufacturer's igniter. As shown therein, at an applied voltage of 115 volts, it reaches gas ignition temperature of 1600° F. in approximately 5 seconds. As energizing of igniter 16 is continued, its temperature rises rapidly, reaching approximately 2500° F. in approximately 20 seconds. As energizing of igniter 16 is continued, for a total energizing time of 45 seconds, its temperature remains relatively stable at approximately 2500° F. so that 2500° F. can be considered to be the final temperature of igniter 16. Since the system must operate properly at specified under-and over-voltages, curves are also shown for the igniter heating characteristics at 97 volts and at 132 volts. The curve for the igniter at an applied voltage of 132 volts shows that the igniter reaches ignition temperature more quickly than at 115 volts and attains a higher final temperature. Such over-voltage performance is acceptable in that the final temperature is stable and is below a temperature which could damage the igniter. The curve for the igniter at an applied voltage of 97 volts shows that the igniter reaches the ignition temperature of 1600° F. in approximately 6 seconds, a temperature of approximately 2100° F. in approximately 15 seconds, and a final temperature of approximately 2200° F. in approximately 20 seconds. Therefore, when it is known that igniter 16 is an igniter having the fast warm-up time characteristics of the igniter of FIG. 3, the igniter warm-up time can be selected to be 15 seconds, by connecting resistor R29 to pin P21 as previously described, even at an applied voltage of 97 volts, igniter 16 will be well above the gas ignition temperature of 1600° F. after being energized for 15 seconds.

Figure 4:
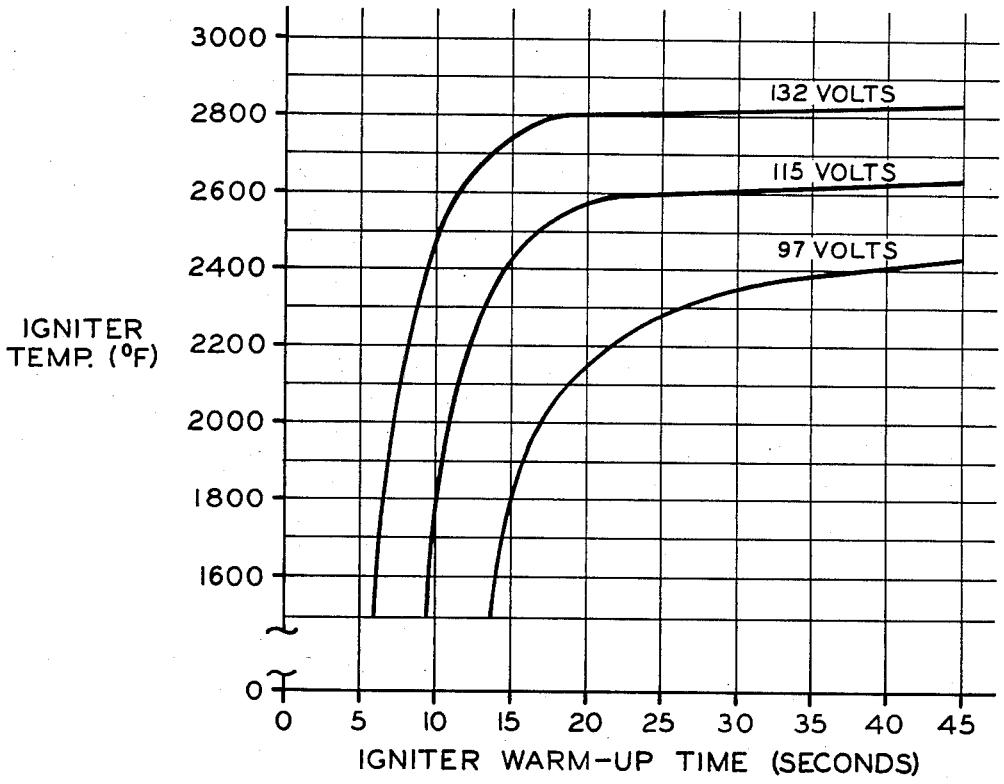
FIG. 4 is a time temperature chart depicting the heating characteristics of as low warm-up igniter at different values of applied voltage.

Referring to FIG. 4, shown generally therein is a time-temperature chart of another manufacturer's igniter. As shown therein, at an applied voltage of 115 volts, the igniter reaches gas ignition temperature of 1600° F. in approximately 10 seconds and attains a relatively-stable final temperature of approximately 2600° F. in approximately 20 seconds. At 132 volts, the igniter performs satisfactorily, reaching ignition temperature more quickly than at 115 volts and attaining a higher final temperature. However, at an applied voltage of 97 volts, the igniter takes approximately 14 seconds to reach the ignition temperature of 1600° F. Therefore, when it is known that igniter 16 is an igniter having the relatively slow warm-up time characteristics of the igniter of FIG. 4, the igniter warm-up time would be selected to be 45 seconds, by not connecting resistor R29 to pin P21 as previously described, since, at an applied voltage of 97 volts, igniter 16 would just barely be at the gas ignition temperature of 1600° F. after being energized for 15 seconds.

Microcomputer M1 is programmed to provide, during normal system operation, the 15-second or 45-second igniter warm-up time selected by the connection or non-connection, respectively, of resistor R29 to pin P21. As will hereinafter be described, microcomputer M1 is also programmed to provide, in conjunction with test device 20 of FIG. 1, an accelerated igniter warm-up time so as to reduce the igniter warm-up time, for assembly line test purposes only, to 10 seconds, regardless of the igniter warm-up time selected.

OPERATION

Prior to describing the accelerated igniter warm-up feature, normal operation of the system will be described.

Normal operation of the system will hereinafter be described based on the circuitry as illustrated, except that test device 20 is not connected to terminal FP of control module 10. Specifically, fan 38 is provided, resistors R30 and R31 are connected so as to provide for three attempts at ignition, resistor R28 is not connected so as to provide for a 30-second pre-purge, and resistor R29 is not connected so as to provide a 45-second warm-up time period for igniter 16.

Prior to a call for heat, the only circuit component energized is primary winding 24 of transformer 22, which is energized through the normally-closed limit switch 26. When thermostat 34 closes its contacts on a call for heat, relay winding 42 is energized, causing its contacts 40 to close. With contacts 40 closed, fan 38 is energized, drawing air from a source external to the furnace, such source being either ambient air when the combustion chamber is not sealed from ambient, or from a separate source, such as outside the dwelling, when the combustion chamber is sealed. The drawn-in air is forced through the combustion chamber and out the flue, thus purging the combustion chamber of any unburned fuel or products of combustion therein. When pressure switch 36 senses the forced flow of air through the flue, it closes its contacts and enables isolation transformer 82 to be energized.

With isolation transformer 82 energized, power is supplied to microcomputer M1, causing it to execute a command of power up. In power-up, microcomputer resets, goes into its run mode, and performs the previously-described ROM and RAM self-checks.

Figure 6:
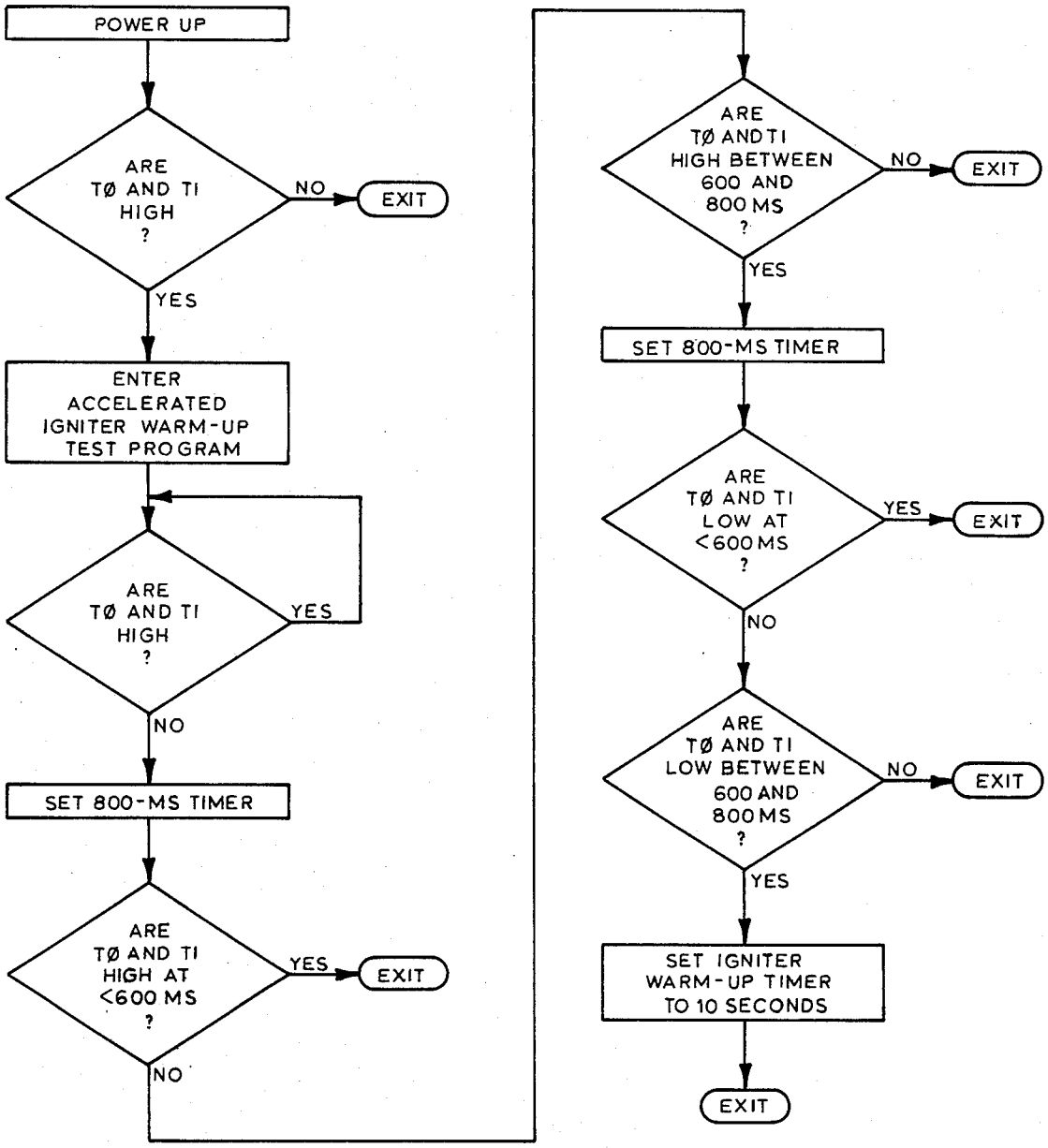
FIG. 6 is a flow chart depicting the logic sequence of the accelerated igniter warm-up time test program programmed into and executed by the microcomputer in the control module.

Microcomputer M1 then monitors pins TØ and T1 to determine if they are high. It is noted that, in the absence of burner flame 54, transistors Q1 and Q2 are off so that pins TØ and T1 should be low. As illustrated in FIG. 6, if pins TØ and T1 are high, microcomputer M1 enters the accelerated igniter warm-up test program, the effect of which will be hereinafter described; if pins TØ and T1 are low, as they should be in the absence of burner flame 54, the program exits to the program for normal operation.

Assuming pins TØ and T1 are low, microcomputer M1 concurrently scans pins P2Ø through P23 to determine if they are high or low. Since pin P2Ø is high due to resistor R28 not being connected, microcomputer M1 sets an internal timer (counter) for 30 seconds. Concurrently, microcomputer M1 establishes a constant high at pin P13 to turn on transistor Q6, a constant high at pins P14 through P17 to turn on transistor Q5, and a constant high at pins P1Ø through P12 to turn off transistor Q4. Concurrently, microcomputer M1 latches pins $DB_6$ and $DB_7$ low to hold transistor Q3 off. Thus, for 30 seconds thereafter, fan 38 is operational and relay windings 108 and 102, which control valves 12 and 14 and igniter 16, respectively, remain de-energized.

After the 30-second timer for pre-purge is timed out, microcomputer M1 establishes a high at pins $DB_6$ and $DB_7$. This high turns transistor Q3 on, enabling relay winding 102 to be energized and effect the closing of its contacts 100. With contacts 100 closed, igniter 16 is energized by the alternating current source at terminals 28 and 30. Since pin P21 is high, due to resistor R29 not being connected, microcomputer M1 sets an internal timer for 45 seconds.

When the 45-second timer is at 4 seconds before timing out, microcomputer M1 effects the turning off of transistors Q5 and Q6. Specifically, microcomputer M1 establishes a constant low at pin P13, turning off transistor Q6, and a 1K Hz. signal at pins P14 through P17, turning off transistor Q5. Since transistor Q4 is also off, the turning off of transistors Q5 and Q6 enables capacitor C10 to charge. As previously described, although 4 seconds are provided, capacitor C10 is charged to the pull-in voltage of relay winding 108 within 2 seconds.

When the 45-second igniter warm-up timer times out, mirocomputer M1 establishes a 1K Hz. signal at pins P1Ø through P12, effecting the turn-on of transistor Q4. With transistor Q4 on, capacitor C10 discharges through resistor R18, relay winding 108, and transistor Q4, enabling the level of energizing of relay winding 108 required to effect the closing of its controlled contacts 106. With contacts 106 closed, valve windings 44 and 46 are energized, effecting the opening of valves 12 and 14, respectively, so as to enable gas to flow to burner 48. Preferably, microcomputer M1 is programmed to compensate for the inherent time delay between the energizing of relay winding 108 and the closing of its contacts 106 by providing the enabling 1K Hz. signal 2 milliseconds before the real time signal, as detected at pin P27, goes low. This 2-millisecond time period enables the closing of relay contacts 106 by relay winding 108 to occur near the zero cross-over of the alternating current source provided by secondary winding 32. It is to be noted that closing of relay contacts 106 near zero cross-over minimizes the wear thereon.

Microcomputer M1 then provides for a trial ignition time period by setting an internal timer for 4 seconds. Igniter 16, whether it is a fast warm-up igniter or a slow warm-up igniter, and even if the applied voltage at terminals 28 and 30 is an under-voltage as low as 97 volts, should be sufficiently hot after being energized for 45 seconds, as illustrated in FIGS. 3 and 4, to ignite the gas at burner 48.

If for some reason ignition does not occur within 3.2 seconds of the 4-second trial ignition time period, microcomputer M1 provides the required signal to effect de-energizing of relay winding 102, which de-energizing terminates heating of igniter 16. If ignition still has not occured by the end of the 4-second time period, microcomputer M1 provides the required signal to effect de-energizing of relay winding 108, which de-energizing effects the closing of valves 12 and 14. Since resistors R30 and R31 are connected to pins P22 and P23, respectively, microcomputer M1 will again attempt ignition. Specifically, microcomputer M1 sets an internal timer for 60 seconds and checks and responds to the selected pre-purge time of 30 seconds indicated by the non-connection of resistor R28 to pin P2Ø to allow fan 38 to purge the combustion chamber for a total of 90 seconds. Microcomputer M1 also increments a retry-sustained ignition counter in RAM to indicate that this was a first attempt at ignition. After the 90-second time period, microcomputer M1 initiates a second attempt at ignition in the same manner as the first attempt, except that an extra 10 seconds is added to the 45-seconds provided for heating igniter 16.

If ignition does not occur during the 4 second trial ignition time period of the second ignition attempt, igniter 16 is de-energized and valves 12 and 14 are closed as described above after an unsuccessful first ignition attempt. Also, the above-described 90-second purge time is again provided, the retry-sustained ignition counter in RAM is incremented to indicate that this was a second attempt, and then a third attempt at ignition is initiated.

For the third attempt at ignition, the extra 10 seconds is again provided so that, again, igniter 16 is heated for 55 seconds before valves 12 and 14 are opened. If ignition does not occur during the 4-second trial ignition time period of the third ignition attempt, the retry-sustained ignition counter in RAM is incremented to indicate that this was a third attempt, and the system subsequently goes into lockout. While the system can be removed from this lockout condition by momentarily opening the contacts of thermostat 34, it is advisable that the cause of repeated failures to ignite be found and corrected before doing so.

When ignition does occur, the existence of burner flame 54 enables the biasing on of transistors Q1 and Q2. With transistors Q1 and Q2 on, a high signal is transmitted through leads 112 and 116 to pins T1 and TØ, respectively. When pins TØ and T1 are high, microcomputer M1 terminates the 4-second trial ignition timer and establishes a low at pins $DB_6$ and $DB_7$ to effect the turning off of transistor Q3. With transistor Q3 off, relay winding 102 is de-energized, effecting the opening of its contacts 106 and thus de-energizing of igniter 16.

When the high signal first appears at pins TØ and T1, microcomputer M1 sets an internal timer for 30 seconds and another internal timer for 700 milliseconds. As previously described, capacitor C4 in the flame rectification circuit 110 can maintain transistors Q1 and Q2 conductive for approximately 80 milliseconds. Thus, should flame 54 fail to impinge flame probe 18 for a time period less than 80 milliseconds due to, for example, a slight flame flicker or distortion, transistors Q1 and Q2 remain on and pins TØ and T1 remain high. Should flame 54 fail to impinge probe 18 for a time period greater than 80 milliseconds, capacitor C4 can no longer maintain conduction of transistors Q1 and Q2 so that they turn off and pins TØ and T1 become low. Microcomputer M1, which is programmed to monitor pins TØ and T1 every 50 milliseconds, detects the low at pins TØ and T1 at its first 50-millisecond check, and decrements the 700-millisecond timer by 50 milliseconds. It is noted that since the monitoring of pins TØ and T1 is based on real time, this first 50-millisecond decrementing can occur very near the time pins TØ and T1 go low or almost 50 milliseconds after they go low. If the absence of flame 54 continues to be indicated, the 700-millisecond timer is decremented every 50 milliseconds until it reaches zero. If flame 54 is again indicated to be present before the 700-millisecond timer reaches zero, the timer is reset for 700 milliseconds and system operation continues.

If the 700-millisecond timer does reach zero, burner flame 54 has thus been indicated as being absent for a maximum of 780 milliseconds. Generally, this would imply that flame 54 is extinguished rather than just flickering. At this point, that is, when the 700-millisecond timer times out, microcomputer M1 effects de-energizing of relay winding 108 so as to cause valves 12 and 14 to close. Concurrently, if the 30-second timer has not timed out, the retry-sustained ignition counter in RAM is incremented to indicate that this was the first occurrence of a failure to sustain flame 54 for at least 30 seconds after it had been established. Microcomputer M1 then checks the counts in the retry-sustained ignition counter. If the count is one, the system returns back to the same program loop that it executes for a second attempt at ignition. That is, the purge fan 38 would operate for 90 seconds, and then microcomputer M1 would initiate an attempt at ignition in the same manner as the first attempt except for a 55-second warm-up period for igniter 16. If the count is two, the system returns back to the same program loop that it executes for a third attempt at ignition. If the count is three, the system goes into lockout.

It is to be noted that a a count of three in the retry-sustained ignition counter could be indicative of three unsuccessful attempts to ignite, or three failures to sustain flame 54 for at least 30 seconds, or a combination thereof totaling three. Thus, the connection of resistors R30 and R31 will always allow three attempts at normal burner operation regardless of whether the counts in the retry-sustained ignition counter are due to unsuccessful attempts at ignition or failures to sustain flame 54 for at least 30 seconds. It is to be noted that when resistor R30 and R31 are not connected, establishing that only one attempt at ignition can be made, the retry-sustained ignition counter is effective to also enable three attempts at normal burner operation but only if the sole problem is that flame 54 is not sustained for at least 30 seconds. That is to say, when resistors R30 and R31 are not connected, a single failure to ignite results in lockout; however, if ignition occurs but flame 54 is not sustained for at least 30 seconds, the system can attempt two more times to sustain flame 54.

The 60-second time period described above ensures safe operation on those systems having no fan 38, such as natural draft furnace systems. Specifically, in such systems, if there is a failure to ignite or if flame 54 is extinguished rather quickly after ignition, there could be a significant amount of unburned fuel in the combustion chamber. In the absence of a pre-purge time, igniter 16 would be immediately re-energized were it not for the 60-second time period. Such reenergizing could cause an undesirable ignition. Thus, the 60-second time period provides a time period for igniter 16 to cool down and for the combustion chamber to vent itself of any unburned fuel.

The above-described means for monitoring flame 54 continues until the 30-second timer initiated by the appearance of the high signal at pins TØ and T1 times out. When this 30-second timer times out, the retry-sustained ignition counter is cleared. Thereafter, monitoring of flame 54 continues in essentially the same manner except that if the 700-millisecond timer times out, the retry-sustained ignition counter is not incremented. Specifically, if flame 54 is lost, microcomputer M1 effects the closing of valves 12 and 14, and the system returns to the same program loop it executes for a second attempt at ignition. That is, the purge fan would operate for 90 seconds (60 seconds plus the 30-second pre-purge), and then microcomputer M1 would initiate an attempt at ignition in the same manner as the first attempt except for a 55-second warm-up period for igniter 16.

When thermostat 34 is satisfied, it opens its contacts, de-energizing all circuit components except primary winding 24 of transformer 22.

The reason for not incrementing the retry-sustained ignition counter if flame failure occurs after the 30-second time period is that the existence of flame 54 for a relatively long period of 30 seconds generally establishes that the system is functioning properly. A flame failure after 30 seconds would generally be caused by a transient condition, such as an abrupt change in gas pressure, which may never occur again.

The reason for allowing more than one attempt at normal burner operation if ignition occurs but flame 54 is not sustained for at least 30 seconds is that again, the failure may be due to some transient condition, and to go immediately into lockout under such a condition could be a nuisance. The reason for limiting such attempts to three is that such flame failure could be an indication of some other problems, such as an improperly positioned flame probe 18, a defective fan 38, or a clogged orifice in burner 48, which problems would not correct themselves on subsequent attempts at normal burner operation. Under such conditions, if the retry-sustained ignition counter were not incremented, the system would continue to attempt normal operation as long as thermostat 34 remained closed and ignition occurred, thus causing a potentially large number of cycles on various circuit components, such as the relays, which cycles could shorten the effective life of the system.

It is noted that the above-described means for monitoring flame 54 relies mainly on the accurate timing inherent in microcomputer M1 rather than on the stability of numerous discrete components. Such a method, therefore, can safely tolerate longer flame-flicker time periods so as to prevent unnecessary recycling or possible nuisance lockouts caused by flame flicker, and yet ensure that the system will automatically recycle within a required time period of 800 milliseconds if flame 54, after being established for some reasonable period of time, is prematurely lost.

It is necessary, in the assembly line of the device such as a furnace or boiler which utilizes the above-described hot surface ignition system, that the system be tested to determine that it operates properly. When the assembly line is geared to a high volume, such as several thousand furnaces per day, it becomes highly desirable to reduce the time expended to conduct such tests.

Among the tests performed is a test to determine that igniter 16 does, in fact, ignite gas. If igniter 16 is a fast warm-up type, as illustrated in FIG. 3, and the 15-second warm-up time has been selected in control module 10, it appears feasible, for test purposes, to reduce the warm-up time to a value somewhat less than 15 seconds. If igniter 16 is a fast warm-up type, as illustrated in FIG. 3, or a slow warm-up type, as illustrated in FIG. 4, and the 45-second warm-up time has been selected in control module 10, it appears feasible, for test purposes, to reduce the warm-up time to a value appreciably less than 45 seconds. Accordingly, as will now be described, microcomputer M1 is programmed to provide, in conjunction with assembly line test device 20, an accelerated igniter warm-up test so as to reduce the time required to test the above-described hot surface ignition system.

To initiate the assembly line test of the system, test device 20 is connected by lead 72 to terminal FP of control module 10, and the terminals to which thermostat 34 is to be connected are shorted. Power is then applied concurrently to control module 10 at power source terminals 28 and 30 and to test device 20 at power source terminals 60 and 62. The value of the applied voltage at terminals 60 and 62 may be any desired value, such as 115 volts. Since the voltage at terminals 28 and 30 is the voltage that will be applied to igniter 16, it is preferable, as will be hereinafter described, that the voltage at terminals 28 and 30 be a voltage higher than 115 volts, such as 132 volts.

Voltage detector 64 in test device 20 responds to a high signal at terminal FP of control module 10 to enable timing circuit 66 to energize its relay coil 76. When relay coil 76 is energized, it effects closing of its contacts 78, which closing connects terminal FB to ground 74 through resistor R1 and rectifier CR1.

When power is initially applied, terminal FP is low since no power is available to control module 10 until purge fan 38 effects the closing of pressure switch 36. Thus, when power is initially applied, relay contacts 78 are open and terminal FP is low. It is also to be noted that at this time, transistors Q1 and Q2 in flame rectification circuit 110 are off so that the signal on pins TØ and T1 is also low. This condition of relay contacts 78 being open and the signal on pins TØ and T1 being low when power is initially applied is illustrated in FIG. 5, time tØ being the time when power is initially applied.

Figure 5:
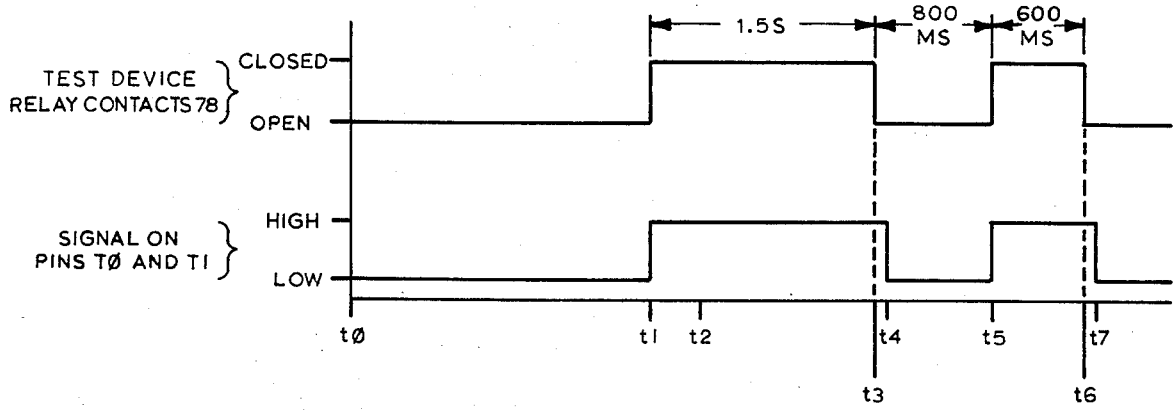
FIG. 5 is a chart depicting the time relationship of the contact status of a relay in the assembly line test device of FIG. 1 and a signal on selected pins of a microcomputer in the control module.

When pressure switch 36 closes, at time t1 in FIG. 5, isolation transformer 82 is energized. The voltage of secondary winding 84 of transformer 82 appears at terminal FP and is detected by voltage detector 64 which causes timing circuit 66 to effect closing of relay contacts 78. With relay contacts 78 closed, transistors Q1 and Q2 are biased on. Specifically, resistor R1 and rectifier CR1 in test device 20 simulate the characteristics of burner flame 54, thus enabling the turning-on of transistors Q1 and Q2. With transistors Q1 and Q2 on, the signal on pins TØ and T1 is high. This condition of relay contacts 78 being closed and the signal on pins TØ and T1 being high at time t1 is illustrated in FIG. 5.

Timing circuit 66 in test device 20 is effective to maintain relay contacts 78 closed for a predetermined time period, preferably approximately 1.5 seconds, sufficiently long to enable microcomputer M1 to execute the power up command. The time at which microcomputer M1 executes the power up command is illustrated as time t2 in FIG. 5.

At power up, as illustrated in FIG. 6, microcomputer M1 inquires whether pins TØ and T1 are high. If pins TØ and T1 are not high, the program exits and executes the program for normal operation as previously described. If pins TØ and T1 are high, as they are at time t2, microcomputer M1 enters the accelerated igniter warm-up test program. Upon entering the test program, microcomputer M1 monitors pins TØ and T1, continually inquiring whether they are high.

At time t3, timing circuit 66 effects opening of relay contacts 78. When relay contacts 78 open, transistors Q1 and Q2 can no longer be biased on by the +5 volt source. They normally will, however, as previously described, remain on for approximately 80 milliseconds due to the discharge of capacitor C4 in flame rectification circuit 110. Thus, transistors Q1 and Q2 turn off approximately 80 milliseconds after relay contacts 78 open, at a time illustrated as time t4 in FIG. 5, and the signal on pins TØ and T1 goes low. It should be noted that if pins TØ and T1 should remain high, microcomputer M1 remains in the loop of inquiring whether pins TØ and T1 are high. A possible cause of pins TØ and T1 remaining high would be that transistors Q1 and Q2 are shorted.

At time t3, when relay contacts 78 open, timing circuit 66 is timed to maintain contacts 78 open for 800 milliseconds. In microcomputer M1, when pins TØ and T1 go low, at time t4, an 800-millisecond timer is set. The next program inquiry is whether pins TØ and T1 are high at less than 600 milliseconds of the 800-millisecond time period in the program of microcomputer M1. With relay contacts 78 timed to remain open for 800 milliseconds, which is, due to the effect of capacitor C4, approximately 720 milliseconds after time t4, the answer should be NO. If the answer is YES, the program exits. It is noted that possible causes of a high on pins TØ and T1 at this time would be a shorted flame probe 18, which would cuase a 60 Hz. signal on pins TØ and T1, or a flickering of flame 54 as the flame is going out due to the closing of valves 12 and 14 caused by a momentary power interruption. If the answer is NO, the program proceeds to an inquiry as to whether pins TØ and T1 are high between 600 and 800 milliseconds.

At time t5, which is 800 milliseconds after relay contacts 78 open, relay contacts 78 again close, and timing circuit 66 is timed to maintain contacts 78 closed for 600 milliseconds. With relay contacts 78 closed, pins TØ and T1 go high. Since time t5 is a time approximately 720 milliseconds into the 800-millisecond time period, the answer to the inquiry as to whether pins TØ and T1 are high between 600 and 800 milliseconds should be YES. The only possible cause of a NO answer here would be that, as a result of a momentary power interruption, flame 54 existed for a short time period after valves 12 and 14 closed, but now flame 54 is extinguished. If the answer is NO, the program exits; if the answer is YES, microcomputer M1 again sts an 800-millisecond timer.

At time t6, which is 600 milliseconds after relay contacts 78 close, relay contacts 78 again open. Again, due to capacitor C4, pins TØ and T1 go low approximately 80 milliseconds after relay contacts 78 close, at a time t7. After time t5, when microcomputer M1 sets the 800-millisecond timer, the program inquiry is whether pins TØ and T1 are low at less than 600 milliseconds. The answer to the inquiry should be NO since the relay contacts 78 are timed to remain closed for 600 milliseconds, and, due to capacitor C4, pins TØ and T1 remain high approximately 80 milliseconds longer. If the answer is YES, the program exits. The only possible cause of a YES answer here would be that flame 54, as it is extinguishing after a momentary power interruption, is extremely erratic. Microcomputer M1 then proceeds to inquire whether pins TØ and T1 are low between 600 and 800 milliseconds. Since time t7 is at 600 milliseconds plus the 80 milliseconds due to capacitor C4, the answer should be YES. The only possible cause of a NO answer would again be an erratic flame 54 after a momentary power interruption. When the answer is YES, microcomputer M1 then sets an igniter warm-up timer for 10 seconds and exits to the program for normal operation, entering the program for normal operation at the step where igniter 16 is energized. As igniter 16 warms up, it begins to glow. Upon the appearance of such a glow, which can be visually observed, test device 20 can be disconnected from control module 10.

Igniter 16 is then energized for 10 seconds rather than the selected warm-up time of 45 seconds. The accelerated igniter warm-up test program would, of course, function in the same manner as described to provide the 10-second warm-up time when the selected warm-up time is 15 seconds.

As illustrated in FIG. 3, when igniter 16 is a fast warm-up type, it is well above gas ignition temperature of 1600° F. after being energized for 10 seconds at an applied voltage of 115 volts. As illustrated in FIG. 4, when igniter 16 is a slow warm-up type, it is only slightly above 1600° F. after 10 seconds when the applied voltage is 115 volts, but is well above 1600° F. when energized for 10 seconds at the preferred test value of applied voltage of 132 volts. Thus, while igniter 16, regardless of whether it is a slow or fast warm-up type, will attain at least the minimum gas ignition temperature of 1600° F. after being energized at 115 volts for 10 seconds, it is preferred that the test value of applied voltage be higher, such as 132 volts.

As stated above, after the 10-second accelerated igniter warm-up time has been established, the program reverts back to the program for normal operation, entering at the program step where igniter 16 is energized. Thus, the system does not execute the 30-second pre-purge function, thereby effecting an additional reduction in assembly line test time when testing those systems which utilize the pre-purge function.

While test device 20 has been illustrated as effecting the particular signal on pins TØ and T1 illustrated in FIG. 5, it is to be understood that the test device 20 and the signal could be of other configurations, the basic requirement being that the signal produced must differ from a signal that may occur under normal or abnormal system operation so that the accelerated igniter warm-up time period is established only during assembly line test, not when the system is functioning in its intended use.

The following components have been found to be suitable for us in the system described herein.

| COMPONENT | TYPE |
|---|---|
| M1 | 8048 (Intel Corporation) |
| L1 | 100 Micro-henries |
| VR | 1N4734A |
| Q1, Q2 | MPS6523 |
| Q3 through Q6 | 2N5551 |
| CR1, CR2, CR3, CR5 through CR8 | 1N4004 |
| CR4, CR9 through CR12 | 1N4150 |
| R1 | 20 M |
| R2 | 10K |
| R3, R5, R7, R9, R11, R21, R27 | 100K |
| R4,R8 | 2 M |
| R6 | 3.9 M |
| R10 | 270K |
| R12, R14, R15, R19, R22 | 4.7K |
| R13 | 47K |
| R16, R17 | 750 ohms |
| R18 | 47 ohms |
| R20,R23 | 1 M |
| R24 | 1K |
| R25 | 8.2K |
| R26 | 390K |
| R28 through R31 | 1.8K |
| C1 | 1000 Mfd. |
| C2 | .1 Mfd. |
| C3 | 22 Mfd. |
| C4 | .022 Mfd. |
| C5, C6 | 20 Pfd. |
| C7 | 2.2 Mfd. |
| C8 | .047 Mfd. |
| C9, C10 | 47 Mfd. |
| C11, C13 | .0047 Mfd. |
| C12, C14 | .0022 Mfd. |

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

I claim:

1. In a gas burner control system, a burner;

an electrical resistance igniter for igniting said burner;

valve means for controlling flow of gas to said burner; and a control module, including a microcomputer, for controlling operation of said igniter and said valve means, said microcomputer being programmed to provide a pre-selected igniter warm-up time period for enabling said igniter to attain a temperature sufficient to ignite gas, said microcomputer being further programmed to provide a test routine including a program for providing an accelerated igniter warm-up time period which is shorter than said pre-selected igniter warm-up time period but sufficiently long for enabling said igniter to attain at least the minimum temperature required to ignite gas, said program in said test routine being executed in response to a unique signal effected by said control module and a test device which is external from and detachably connected to said control module.

2. The control system claimed in claim 1 wherein said pre-selected igniter warm-up time period is pre-selected at approximately 15 or 45 seconds, and said accelerated igniter warm-up time period is approximately 10 seconds.

3. In a gas burner control system, a burner;

an electrical resistance igniter for igniting said burner;

a flame probe for detecting presence of a burner flame;

valve means for controlling flow of gas to said burner; and a control module, including a programmable microcomputer for controlling operation of said igniter and said valve means, said control module further including a flame rectification circuit connected between said microcomputer and an input terminal of said control module to which terminal said flame probe is connected, said flame rectification circuit being effective to provide said microcomputer with signals indicative of absence and presence of burner flame for enabling said microcomputer to execute a program for normal operation, said program for normal operation including a provision of a preselected igniter warm-up time period for enabling said igniter to heat up to gas ignition temperature, said flame rectification circuit being further effective to provide said microcomputer with a unique signal, effected by said control module and a test device which is external from and connected, for test purposes only, to said input terminal of said control module to which terminal said flame probe is connected, for enabling said microcomputer to execute a test program, said test program including a provision of a reduced igniter warm-up time period which is shorter than said pre-selected igniter warm-up time period but sufficiently long for enabling said igniter to attain at least the minimum temperature required to ignite gas.

* * * * *